US005523513A

United States Patent [19]

Milner

[11] Patent Number: 5,523,513

[45] Date of Patent: Jun. 4, 1996

[54] DECONTAMINATION PROCESSES

[75] Inventor: Timothy N. Milner, Cumbria, United Kingdom

[73] Assignee: British Nuclear Fuels plc, Cheshire, United Kingdom

[21] Appl. No.: 361,524

[22] Filed: Dec. 22, 1994

[30] Foreign Application Priority Data

Nov. 4, 1994 [GB] United Kingdom ..... 9422539

[51] Int. Cl.[6] ..... G21F 9/00

[52] U.S. Cl. ..... 588/1; 588/20; 210/710; 210/729; 210/758; 210/759; 134/3; 134/13; 976/DIG. 376

[58] Field of Search ..... 588/1, 20; 134/3, 134/10, 13; 210/702, 758, 759, 710, 729; 976/DIG. 376

[56] References Cited

U.S. PATENT DOCUMENTS 3,873,362 3/1975 Mihram et al. ..... 134/3
4,828,759 5/1989 Hanulik ..... 252/628
5,008,004 4/1991 Hanulik ..... 252/628
5,128,266 7/1992 Hanulik ..... 436/57
5,266,214 11/1993 Safarzedeh-Amiri ..... 210/748

FOREIGN PATENT DOCUMENTS 1783585 12/1992 U.S.S.R. .

*Primary Examiner*—Ngoclan Mai
*Attorney, Agent, or Firm*—Nixon & Vanderhye

[57] ABSTRACT

A method of decontaminating the surface of a body carrying radioactive contaminants which comprises treating the surface with a decontaminant comprising a solution of tetrafluoroboric acid $HBF_4$, treating the resultant liquor comprising decontaminant and dissolved species removed from the body surface with a first chemical agent which on reacting with dissolved species yields insoluble compounds and regenerated decontaminant solution, and characterized in that the regenerated decontaminant solution is further treated to cause removal of the first chemical agent from the decontaminant solution.

17 Claims, 4 Drawing Sheets

DECONTAMINATION PROCESSES

BACKGROUND OF THE INVENTION

The present invention relates to decontamination processes. In particular, it relates to chemical decontamination of the surfaces of bodies contaminated by radioactive species.

Plant and equipment used in the processing, handling, transport and storage of radioactive materials, eg as in the nuclear materials processing or reprocessing industry, becomes contaminated during routine operations. Where contamination levels result in an excessive radiation hazard to plant operators a process for reducing the potential radiation hazard by decontamination is required to be employed. Also, redundant plants or components require decontamination during decommissioning operations to minimise the volume of bulk material requiring disposal as radioactive waste categorised as intermediate level waste (ILW). Removal of the radioactive contaminants from such plants and components in minimum volume allows the bulk material to be recategorised as low level waste (LLW) which category is considered much less hazardous and is therefore much cheaper to store, transport and dispose of than ILW.

There are many well established methods employed in the nuclear industry which use chemical formulations based upon strong mineral acids for the dissolution of radioactive contaminants contained on the surfaces of bodies to be decontaminated. Examples of such formulations are based upon nitric acid, phosphoric acid and hydrochloric acid. These formulations, which may also include oxidising agents and/or fluoride ions, eg applied in the form of sodium fluoride or hydrofluoric acid, can achieve rapid dissolution of metallic substrates, such as stainless steel, used as plant structures and components. These formulations are therefore used as solvents to dissolve a surface layer of the contaminated body or substrate, the surface contaminants being extracted by the solvent as part of the surface layer removal.

Such dissolution processes are very aggressive and cannot achieve uniform substrate surface removal because of preferential attack of stress cracks, island corrosion sites and other substrate surface non-uniformities. Corrosive and toxic fumes are also frequently released during the dissolution reaction requiring the provision of complicated and expensive off-gas scrubber systems.

A major disadvantage of these strong mineral acid decontamination processes is that the acid becomes a contaminated waste stream requiring further processing. Prior to neutralisation and discharge to the environment, it is necessary to remove, eg by floc precipitation and/or ion exchange, the contaminant species which may subsequently be immobilised and encapsulated in a solid matrix as a solid ILW. This consequently gives rise to considerable volumes of radioactive secondary wastes and liquid effluents.

Other milder decontamination processes, typically employed in nuclear reactor cooling circuit decontamination, have reduced the problems arising from the volume of the secondary waste in the aforementioned processes. Formulations of organic reagents such as vanadous formate, oxalic/citric acid used in successive cycles, with pretreatment to oxidise the contaminants, can solubilise the contaminant activation products and transport them for entrainment on organic ion exchange resins, where the organic reagent is simultaneously regenerated for re-use. Such processes offer a significant reduction in liquid effluent arising over the strong mineral acid processes, although they do show two notable disadvantages. Firstly, the spent organic ion exchange resin produced is a relatively unstable ILW. Secondly, the organic reagents cannot solubilise actinides and certain fission products or achieve a kinetically favourable dissolution of stainless steel bodies beneath the superficial oxide layer formed on such bodies. These disadvantages render such mild processes ineffective for the decontamination of many nuclear plant structures and components.

Recent developments in the field of nuclear plant decontamination have involved the use of tetrafluoroboric acid, $HBF_4$. This acid is a well known solvent for metals and has been used in the metal finishing industry for many years. It is a comparatively inexpensive mineral acid produced, for example, as a by-product of the aluminium extraction industry. $HBF_4$ can achieve a maximum capacity for dissolving iron of 220 grammes per liter, which compares with a capacity of 20 grammes per liter for dissolution of iron by concentrated $HNO_3$. This demonstrates a clear advantage in using $HBF_4$ for the dissolution of metals to provide surface decontamination. Furthermore, $HBF_4$ achieves a uniform attack of metal surfaces without exhibiting preferential dissolution of stress cracks or island corrosion sites and the stability of the reaction products ensures minimal toxic gases are released during metal dissolution. The large capacity for iron dissolution and the rapid reaction kinetics of the dissolution process allow low concentrations of $HBF_4$ to be used in the decontamination process and allow stoichiometric control of the metal dissolution process such that corrosion of the components being decontaminated can be maintained at a practical minimum. This stoichiometric control of the dissolution process is an important feature of $HBF_4$ decontamination when structures or components are to be returned to service after decontamination as it is possible to demonstrate that the structural integrity of the bulk component or plant has not been compromised during the decontamination process.

A minimal liquid effluent process for decontamination of nuclear plant using $HBF_4$ has been described in the prior art. $HBF_4$ which has been used in the decontamination process is passed to an electrochemical cell where it is regenerated for re-use. Metal contaminants are also removed from the acid in the cell. The process is dependent on balancing the rate of dissolution of iron with the electrochemical regeneration process. The optimum iron dissolution capacity is 70 to 72 grammes per liter which is much less than the maximum possible capacity of 220 grammes per liter. A major disadvantage of this known process is that the decontamination liquor always contains a quantity of dissolved metal and radioactive contaminants. The presence of these contaminants which are not recovered electrochemically can present a serious criticality and radiation dose hazard.

Another known process is described in SU 1783585A1. This employs two different decontaminants in successive decontamination stages. In a first stage $HBF_4$ solution is used to remove an initial layer 1 to 10 μm thick from the surface of the body to be decontaminated. Oxalic acid is used to regenerate $HBF_4$ from the liquor containing dissolved material from the body surface. This $HBF_4$ is re-applied to the body surface. However, the re-applied $HBF_4$ contains oxalic acid and oxalates of radionuclides and these oxalates are caused to plate out on the body surface. In a second decontamination stage another decontaminant comprising $H_2SO_4$ is applied to the body surface which removes a further layer of the surface including the plated oxalates.

The disadvantages of the process described in SU 1783585A1 are that radionuclides initially removed from the body surface in the first stage are subsequently re-plated on the body surface and that the decontaminant used in the second stage is not intended to be re-generated and re-applied which means that the liquid effluent from the second stage is substantial and requires further treatment to remove radionuclides therefrom before the effluent can be safely discharged.

SUMMARY OF THE INVENTION

It is an object of the present invention to provide a decontamination process which can employ a single type of decontaminant solution which provides uniform surface decontamination, which can be regenerated and re-applied, from which solution dissolved species including radionuclides can be separated and which process produces minimal liquid and solid effluent.

According to the present invention there is provided a method of decontaminating the surface of a body carrying radioactive contaminants which comprises treating the surface with a decontaminant comprising a solution of tetrafluoroboric acid $HBF_4$, treating the resultant liquor comprising decontaminant and dissolved species removed from the body surface with a first chemical agent which on reacting with the dissolved species yields insoluble compounds and regenerated decontaminant solution, and characterised in that the regenerated decontaminant solution is further treated to cause removal of the first chemical agent from the decontaminant solution.

The said removal may be by chemical degradation/destruction.

In the following description "decontaminant solution" refers to the $HBF_4$ solution before contacting the body to provide decontamination and "decontamination liquor" comprises the liquor produced following such decontamination. Such liquor will contain a number of dissolved species.

The body to be decontaminated may be a metallic body, eg a metallic structure or component forming part of a nuclear reactor plant or a nuclear fuel material processing or reprocessing plant or a container employed for the transport or storage of such material. The body may comprise iron, copper, lead or another common metal. Alternatively, the body may comprise a component made of polymeric or other non-metallic material.

The first chemical agent may comprise an acid such as one or more of oxalic acid, phosphoric acid, silicic acid and sulphuric acid. Desirably, the first chemical agent provides precipitation of dissolved metals and radionuclides contained in the decontamination liquor. The first chemical agent preferably comprises oxalic acid. The molar amount of the first chemical agent added is preferably in the range 0.9 A to 1.5 A where A represents the number of moles of dissolved metal ions which will be in the decontamination liquor (ie spent $HBF_4$ solution). The quantity A can vary depending on the stage the process has reached. It can be measured continuously or at discrete process stages to determine the amount of reagents to be added.

The said further treatment may cause oxidation or reduction of the first chemical agent to convert it to one or more products which do not remain in the decontaminant solution.

Where the first chemical agent comprises oxalic acid the said further treatment may comprise oxidation which converts oxalic acid or oxalate to carbon dioxide and water. The said further treatment may comprise addition of a second chemical agent or alternatively it may comprise an electrochemical reaction which provides oxidation and destruction of the first chemical agent or alternatively the said further treatment may comprise photolytic decomposition.

The molar amount of the second chemical agent where added is preferably in the range 0.05 A to 0.1 A where A, as defined above, represents the number of moles of dissolved metal ions in the decontamination liquor.

Where a second chemical agent is employed as an oxidising agent the agent may comprise a known strong oxidising agent such as potassium permanganate, potassium dichromate, or a lead (IV) or cerium (IV) compound.

Where the said further treatment comprises photolytic decomposition such treatment may be carried out in a known way using visible and/or ultra-violet radiation. Such decomposition may be assisted by use of other agents known to assist the reaction, eg applied heat, agitation and/or the use of a catalyst, eg a semiconductor material such as $TiO_2$, or a metal such as chromium. UV radiation is known to decompose oxalic acid and its ferric salts and complexes. This process is efficient in terms of its usage of incident radiation. The use of UV radiation to decompose oxalic acid in the presence of $HBF_4$ and iron and also other metal contaminants (without catalytic assistance) has been found to result in $CO_2$ production and reduction of Fe(III) to Fe(II) thus providing the required removal of oxalic acid and its salts and complexes from solution. $HBF_4$ has a featureless UV absorption spectrum above about 280 nm and the UV radiation employed preferably has a wavelength below this value. For example, the radiation may be obtained from a mercury discharge lamp directed toward the liquor to be treated in a known way.

In a further optional treatment step which may be employed in the method according to the present invention a third chemical agent may be added to the precipitate produced by the addition of the first chemical agent and/or addition of the second chemical agent (where employed) or application of the said further treatment, eg by UV application, to the decontamination liquor to increase the rate of removal or destruction of the first chemical agent. This may also cause reduction of the volume of precipitate. The third chemical agent may comprise a trace volume of peroxide, eg $H_2O_2$. Normally a molar amount in the range of 0.005 A to 0.01 A is suitable where A is the number of moles of dissolved metal ions in the decontamination liquor. This may provide up to 0.02% vol/vol for example.

In a further optional treatment step which may be employed in the method according to the present invention, the regenerated decontaminant solution may be further purified by passage through an inorganic adsorber and/or ion exchange medium selected with knowledge of the contaminant species present on the surface of the body to be decontaminated so as to remove trace contaminant species not removed by the first chemical agent or the step in which the first chemical agent is removed or destroyed. Such a step may be applied continuously during the process and/or at the end of the decontamination procedure, ie before storage or neutralisation and discharge (as appropriate) of the $HBF_4$ acid solution.

The fluoroborate anion is reprotonated by the first chemical agent to yield $HBF_4$ solution which can be re-used for decontamination of the body surface. The present invention allows this regeneration to be carried out without the problems encountered in the prior art. The further treatment or treatments allow $HBF_4$ solution to be regenerated in substantially pure form, ie without dissolved species such as oxalates which (as in the prior art) cause plating of radionuclide species on the surface to be decontaminated. A further decontaminant solution producing a different effluent stream is therefore not needed.

The $HBF_4$ regeneration may be carried out continuously or at one or more discrete stages following decontamination.

The further treatment step, eg where the further treatment comprises use of a second chemical agent, may provide, in addition to removal or destruction of the first chemical agent, eg oxalic acid, in the regenerated decontaminant solution, precipitation of certain species not precipitated by the first agent. For example, americium is not precipitated by oxalic acid but is precipitated by potassium permanganate.

The precipitate produced by addition of the first chemical agent to the decontamination liquor is preferably separated from the liquor before the liquor is further treated, eg by addition of a second chemical agent. Similarly, any precipitate produced after the further treatment, eg addition of a second chemical agent, is preferably separated from the liquor before subsequent treatments, eg further purification of the regenerated decontaminant solution using an ion exchange medium.

At each of the stages where a precipitate is formed and is required to be separated the precipitate may be separated using a known process, eg filtration.

Filtrate material recovered from the decontamination liquor in one or more of the steps in the method according to the present invention and the filters on which such material is collected may be collected in a common sludge. For example, such a sludge may comprise a mixture of radionuclides, oxalates and manganese dioxide precipitates and polymeric, eg polypropylene, bag filters. Such a recovered sludge may be treated in a known way, eg by calcining in a furnace, at a temperature of 400 C. to 700 C., to yield a stable, solid waste form in a minimal volume form suitable for disposal as either ILW or LLW depending upon the radionuclide inventory.

The process of continuously or periodically recovering the dissolved metals and contaminants in a concentrated filtrate whilst regenerating the decontaminant solution ensures that the dissolved contaminants do not concentrate in solution giving rise to radiation dose or criticality hazards to plant operators.

Acid regeneration in this manner which is not reliant on a high concentration of dissolved metal ions allows decontamination using low concentrations of $HBF_4$ in the decontaminant solution in order to minimise the quantity of metal and hence contaminants removed. This ensures that radiation levels in the decontamination liquor are minimised and the resultant solid waste is efficiently solidified thereby avoiding the need for an expensive, complex remotely operated decontamination process. This in turn can, for example considerably reduce the cost of nuclear decommissioning work.

In addition, limiting the rate of surface dissolution of the body to be decontaminated to a uniform minimum can ensure that the structural integrity of the body is not compromised and the body can, if required, be returned to service if required after decontamination.

In the method according to the present invention, the step of contacting the contaminated body by the decontaminant solution may be carried out in one of a number of known ways eg immersing the body in a vessel containing the decontaminant, spraying the body surface, or, where the body surface to be decontaminated comprises the interior surface of a vessel or pipe or the like, flow or circulation of the contaminant through the vessel or pipe etc.

In the method according to the present invention, the treatment by the first chemical agent and the treatment to remove the first chemical agent, eg by addition of the second chemical agent and optionally the treatment comprising addition of the third chemical agent, may be carried out as successive steps in a single treatment vessel. Where the agents are not compatible, eg potassium permanganate and $H_2O_2$ form an explosive mixture, they are desirably applied to the vessel via different inlets.

Preferably, the depth of contamination of the surface of the body to be treated and the contaminant species present is found, prior to application of the decontaminant, by analysis of one or more representative samples of the body surface. This data is employed to determine the optimum concentration and temperature of the decontaminant.

A plurality, eg several, decontamination contacting and re-generation cycles may be employed in the treatment of a given body to minimise the concentration of radionuclides and hence radiation dose levels in the decontamination liquor and the resultant waste form. Where several such treatment cycles are required the body to be treated is desirably contacted with the decontaminant by spraying. For example, for treatment of a mild steel component exhibiting high levels of contamination deeply penetrated into its surface a low concentration of $HBF_4$, eg between 2 and 7 per cent by volume in water, would be suitable for decontamination at a moderately elevated temperature, eg 40° to 80° C. A 5% acid in water solution applied at 60° C. to such a component offers a dissolution rate of 4 to 5 μm per hour and a maximum dissolved iron concentration of 22 grammes per liter.

For a component made of stainless steel lightly contaminated to a small depth of 5 to 10 μm, a high acid concentration aqueous solution, eg 50% $HBF_4$ in water at 50° C. may be employed in a single treatment cycle, ie without recycling decontaminant to re-treat the component, since liquor radiation dose levels will not be high.

In the method according to the present invention the decontamination liquor comprising spent $HBF_4$ after contacting the body to be treated may before contacting by the first chemical agent be passed through a particle separator, eg filter, which conveniently removes undissolved particles, eg organic matter such as algae or paint, or sintered oxides or $PuO_2$. The filtrate so produced may be combines with that produced in the subsequent step(s) and treated in the manner described above.

As the dissolution reaction proceeds during the decontamination of a given body, if the same decontamination solution is in contact with the body over a period of time the concentration of metal ions and radionuclides in solution will increase and the concentration of $HBF_4$ will decrease causing the pH to rise and the rate of dissolution to fall. The dissolution reaction which takes place using iron as an illustrative example is as follows:

$$Fe^2+2HBF_4 \rightarrow Fe(BF_4)_2+H_2$$

$$FeO+2HBF_4 \rightarrow Fe(BF_4)_2H_2O$$

Other metals behave in a similar way to form fluoroborate complexes.

As noted above, the acid regeneration step may be carried out by transferring the contaminated liquor, ie $HBF_4$ solution in which contaminants have become dissolved, to a separate waste treatment vessel. This may beneficially include means for heating the liquor and may include means for agitating the liquor eg an electrically operated paddle. The vessel may also include a pH monitor.

Where the first chemical agent comprises oxalic acid regeneration of $HBF_4$ from $Fe(BF_4)_2$ proceeds as follows:

$$Fe(BF_4)_2+H_2C_2O_4 \rightarrow FeC_2O_4+2HBF_4$$

The iron oxalate produced forms a precipitate which can be separated in a known way. Other metals such as cobalt, nickel, manganese also form insoluble oxalates in a similar way. Many fission products and actinides, notably plutonium also form insoluble oxalates which are removed together with the iron oxalate.

The regenerated acid solution containing oxalate precipitates may conveniently be pumped through a filter to remove the precipitates.

We have found that even highly soluble radionuclides such $Cs^{137}$ can be separated by this process by adsorption on the oxalate filtrate particles.

Where dissolved oxalate species and excess oxalic acid applied as the first chemical agent are removed by treating the decontaminant liquor in the acid regeneration vessel with a suitable oxidising agent, eg potassium permanganate, the oxidising agent may be applied in solid form. The liquor may be heated, eg to a temperature of 60° to 100° C. The oxidising agent causes destruction of the oxalate and oxalic acid yielding carbon dioxide and water in a self-sustaining cyclic reaction, producing hydrogen peroxide as an intermediate product. At the end of this reaction a precipitate of manganese dioxide is produced. This adsorps the residual iron present together with other residual contaminants such as americium. The oxalate/oxalic acid destruction reaction can be increased by adding a trace volume of $H_2O_2$, which as noted above also has the effect of reducing the volume of precipitate.

Neutralisation of the regenerated $HBF_4$ solution may at the end of the decontamination process be achieved in the waste treatment vessel by addition of a basic material, eg calcium hydroxide, to yield an insoluble calcium fluoride compound which can be filtered and combined with the other filtrates and calcium metaborate solution which can be discharged, optionally after ion exchange treatment as described above, as a liquid effluent in a conventional manner. The molar amount of basic material added may be in the range 2 A to 4 A where A is the number of moles of dissolved metal ions in the decontamination liquor.

Embodiments of the present invention will now be described by way of example with reference to the accompanying drawings, in which:

BRIEF DESCRIPTION OF THE PREFERRED EMBODIMENTS

Figure 1:
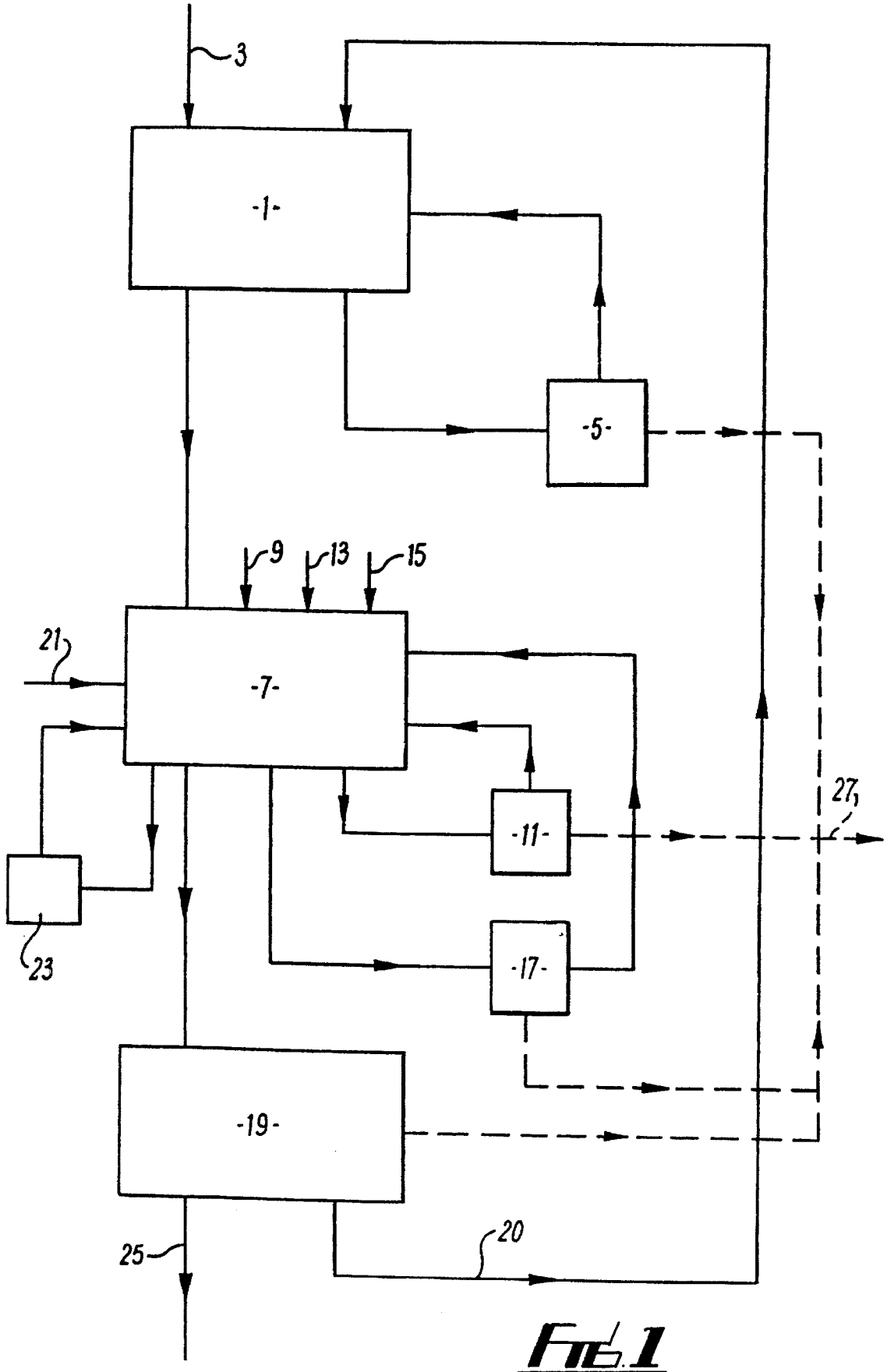
FIG. 1 is a schematic flowsheet illustrating the steps involved in a decontamination method embodying the present invention.

In the process illustrated in FIG. 1, boxes represent steps in the process, full lines with arrows represent flow of liquids and broken lines with arrows represent transfer of solids. A body to be decontaminated (not shown) is contacted in a contacting stage 1 with $HBF_4$ solution from a supply 3. A spent $HBF_4$ decontamination liquor containing material including contaminants removed from the body surface is produced thereby. The liquor is passed through a filtration stage 5 to remove solid matter, eg paint, algae and some undissolved radionuclides or metals etc removed from the body surface. When the liquor has been filtered it is passed to a treatment vessel in which precipitation 7 is carried out to provide $HBF_4$ regeneration.

Firstly, oxalic acid from a source 9 is added to the liquor to form oxalate precipitates in the manner described above.

The liquor is then passed through a filtration stage 11 to remove the oxalate precipitates and returned to the treatment vessel for further precipitation treatment. Nest, $KMnO_4$ in solid form is applied from a source 13 to the decontamination liquor. A trace volume of $H_2O_2$ from a source 15 is added to the liquor to increase the reaction by the $KMnO_4$. The liquor is then passed through a filtration stage 17 to remove the precipitate so formed. The filtered liquor comprising nearly pure regenerated $HBF_4$ solution is thereafter passed through an ion exchange stage 19 to provide further purification of the solution. The clean $HBF_4$ solution produced thereby may be re-applied at further discrete stages or continuously to the contacting stage 1 via a recirculation loop 20 to provide further decontamination of the object.

At the end of the decontamination of the object, the decontamination liquor is returned to the vessel in which precipitation 7 is carried out. Calcium hydroxide is applied from a source 21 to neutralise the $HBF_4$ acid. The precipitate so produced is filtered in a filtration stage 23 and the resultant neutralised, filtered liquor, which may be further purified by passage through the ion exchange stage 19, is subsequently discharged as a substantially clean, neutral liquid effluent stream 25.

Solid matter comprising filtrate and filters containing them from the filtration stage 5, 11, 17 and 23 and spent ion exchange material (eg in the form of a cartridge) from the ion exchange stage 19 is transferred to a common solids waste 27 which is treated where appropriate by calcining for subsequent assay, storage and onward transport and disposal as ILW or LLW as appropriate, In a variation of this process the oxidation treatment by addition of potassium permangonate may be replaced by photolytic oxidative treatment of the decontamination liquor using UV radiation in a known way. This treatment may be followed by the addition of $H_2O_2$ and the other following steps described above.

EXAMPLE 1

Figure 2:
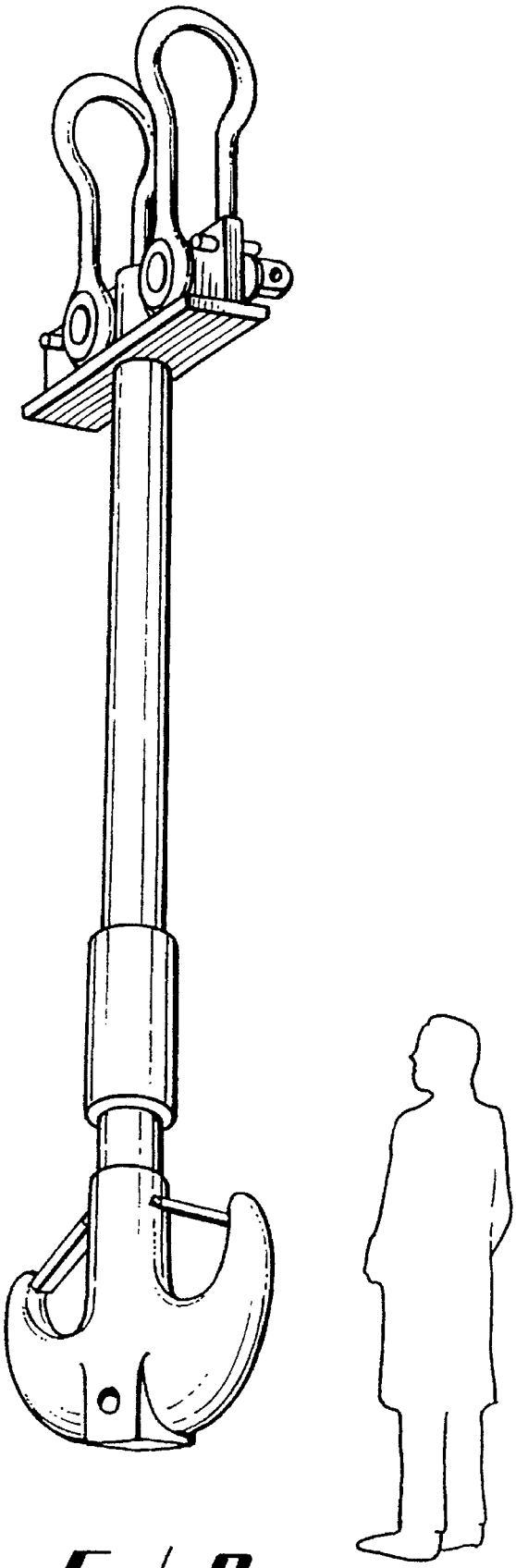
FIGS. 2 and 3 are perspective views of different lifting beam components to be decontaminated.
Figure 3:
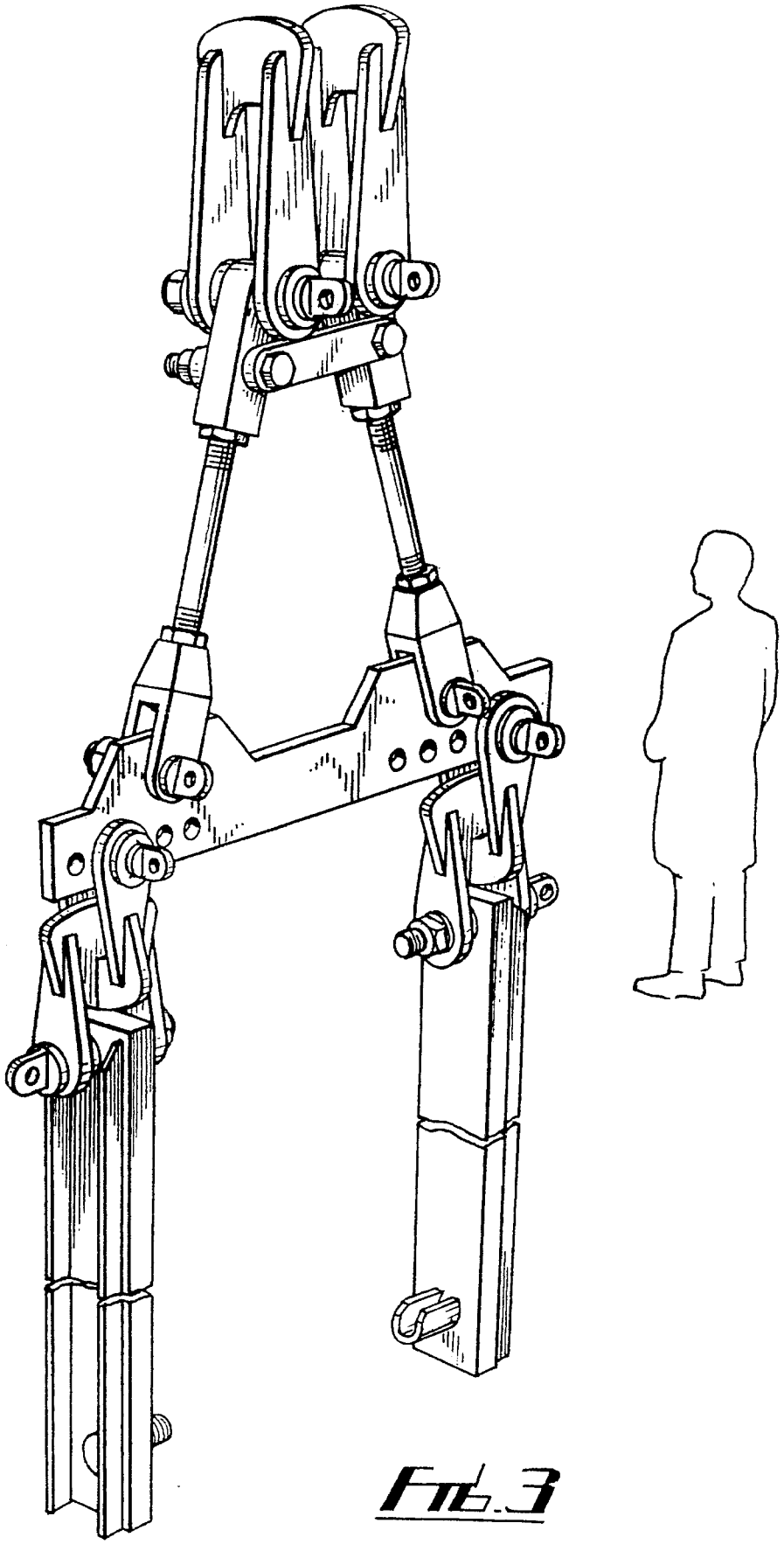

In a first example of a method embodying the present invention decontamination of very large, highly contaminated components was carried out by a remotely controlled process. A number of very large lifting beams, used for the transfer of spent nuclear fuel in skips around fuel storage ponds, were required to be decontaminated. FIGS. 2 and 3 illustrate the size and shape of the lifting beams. Contamination levels were measured as giving rise to contact dose rates of 20 mSv/hr which required the method to be performed remotely.

Initial laboratory trials were performed to determine the concentration and temperature of tetrafluoroboric acid to be used. It was apparent that an immersion method would require a very large volume of decontamination liquor owing to the size of the lifting beams. Spraying was therefore chosen as the contacting method. Further laboratory trials were conducted to optimise the spraying. A 1% solution of $HBF_4$ at a temperature of 60° C. was identified as the optimum for the decontamination solvent.

Lifting beams of the types shown in FIGS. 2 and 3 (four in total) were decontaminated removing 0.7 GBq of $Co^{60}$ and 0.64 GBq of $Cs^{137}$, in total 1.34 GBq were removed. Treatment of the contaminated liquor was performed generally in the manner shown in FIG. 1. The first treatment involved the addition of oxalic acid. Further treatment in the manner described above was applied using potassium permanganate addition followed by $H_2O_2$ addition. Subsequently, the resulting liquor was filtered and then passed through inorganic ion exchange adsorbers for extraction of residual caesium left in solution after filtration of the oxalates. At the end of the several decontamination cycles of the process the $HBF_4$ solution was finally neutralised with calcium hydroxide. The calcium fluoride thereby produced was removed by filtration and the near neutral solution which was found to contain 8 Bq/ml $Co^{60}$ and 3 Bq/ml $Cs^{137}$ was discharged to a pond water treatment plant for further purification and de-activation.

Figure 4:
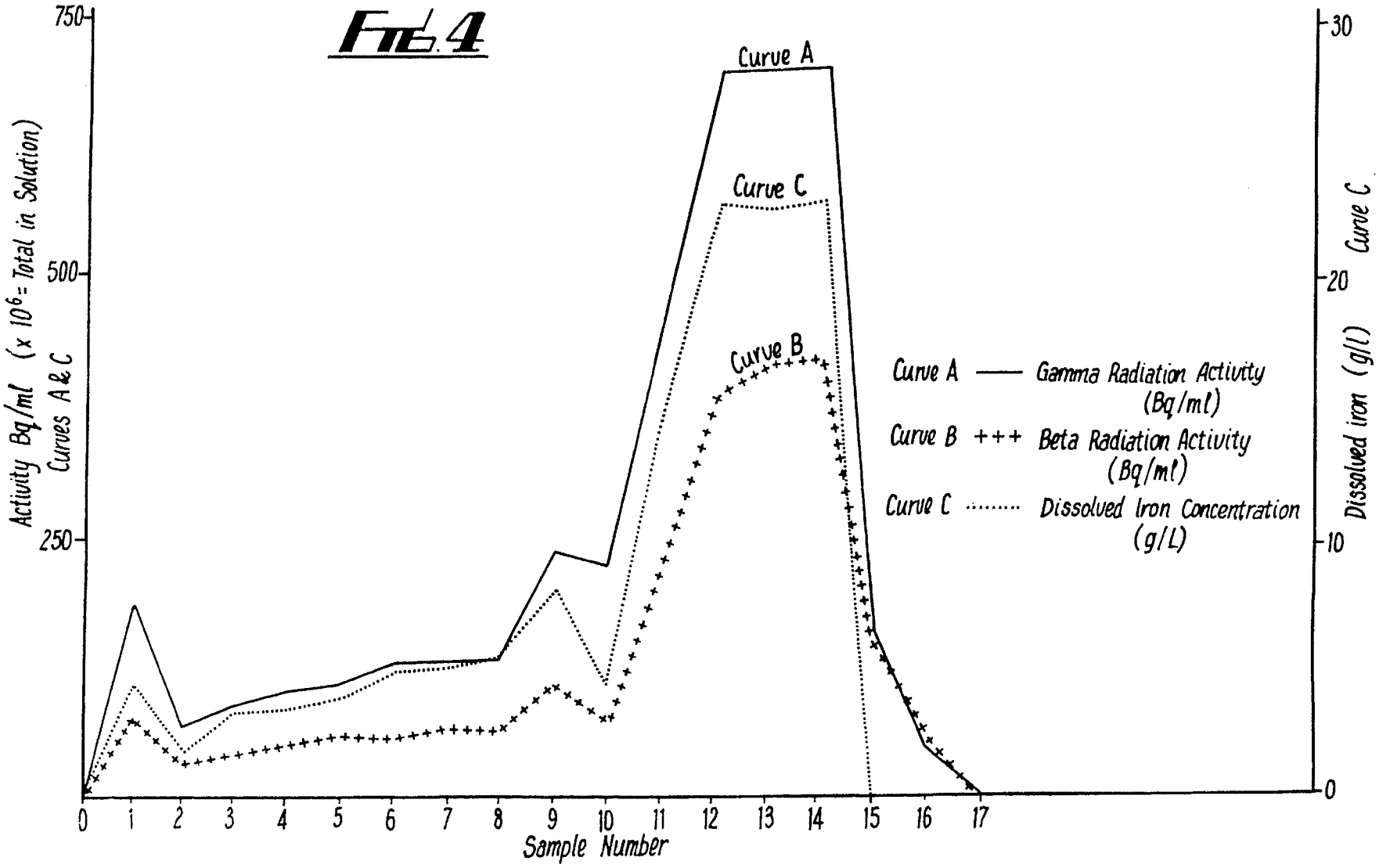
FIG. 4 is a graph of activity and dissolved iron concentration of decontaminant liquor against time in the decontamination of the components shown in FIGS. 2 and 3.

Results obtained in this Example are shown in FIG. 4 where gamma and beta activities of the liquor containing contaminants before acid regeneration and dissolved iron concentrations are plotted together on the vertical axis against sample numbers on the X axis. Samples of the liquor were taken and measured every 24 hours throughout a 17 day continuous decontamination programme.

FIG. 4 demonstrates correlation between iron removed and contamination removed, validating the findings of the laboratory contamination profiling experiments which had previously been carried out. The efficiency of the filters is demonstrated by the graph between samples 1 and 2 where activity notably decreases when a fouling layer has been built up and again, after sample 8, when a filter has been replaced; activity increases and then falls when a fouling layer has been built up after this filter replacement. After ten days it was decided to increase acid concentration in the process to 5% by volume. This improved decontamination rates due to improved reaction kinetics, this improvement is demonstrated by the steep rise in the graph between samples 10 and 12. The final lifting beam, a lightly contaminated, heavily painted component, was introduced after sample 12. The graph shows a slight increase in radionuclide inventory at this stage arising to the light contamination and moderate increase in dissolved iron due to the item being largely protected by a paint layer.

The rapid fall in beta and gamma activity and the almost complete removal of dissolved iron between samples 14 and 15 in FIG. 4 corresponds with the first regeneration/waste removal step using oxalic acid/potassium permanganate. A further decrease between samples 15 and 16 represents the addition of inorganic ion exchange adsorbers and the final decrease in beta and gamma activity between samples 16 and 17 corresponds with the addition of calcium hydroxide.

The graph shows that the waste treatment/acid regeneration step applied after sample 14 provided a 100% reduction in dissolved iron, a 99.9% reduction in beta activity and 99.95% reduction in gamma activity. Complete removal into waste form was thereby obtained for dissolved iron and a 99.9% removal into solid waste form was obtained for the radioactive contaminants.

As a result of the above treatment all of the beams were decontaminated to an activity level less than a 100 μSv target in less than a month. The beams were suitable to return to service thereafter. The volume of solid waste produced was only 1.1 $m^3$ which was suitable for disposal via an existing LLW route. This waste contained 99.9% of the removed radionuclide contaminants. The volume of spent near neutral liquor which was discharged to a water treatment plant was only 2 $m^3$.

EXAMPLE 2

In a second example of a method embodying the present invention, a highly contaminated redundant plant components which had been employed in the production of mixed uranium oxide/plutonium oxide fuel were required to be decontaminated. In this example, the tetrafluoroboric acid solution was continuously regenerated during the decontamination process to ensure that levels of fissile material were maintained at sub-critical masses below the acceptance criteria for plutonium contaminated waste of 450 g/200 L of waste. This had been achieved in laboratory trials using a 5% solution of tetrafluoroboric acid at a temperature of 80° C. to decontaminate mild steel, stainless steel, painted steel, aluminium, brass and plastics components having maximum alpha contamination levels in excess of 3000 cps. Using a 1 liter batch of $HBF_4$ solution the decontamination of the contaminated plant components was carried out by concentrating dissolved iron to a level of 22 g/L and $2.2\times10^8$ Bq of alpha activity/L before requiring regeneration.

Regeneration of the acid decontaminant was accomplished by oxalic acid coprecipitation of iron and plutonium oxalate and americium adsorption using potassium permanganate to generate manganese dioxide in the manner described above.

The following results were obtained in the decontamination process.

Activity in solution before acid regeneration=$2.2\times10^8$ Bq

Activity in solution after acid regeneration=$5\times10^2$ Bq/ml

Solution capacity for iron before acid regeneration=22 g/L

Solution capacity for iron after acid regeneration=20 g/L

Rate of metal dissolution before acid regeneration—mild steel=20 μm/hr

Rate of metal dissolution after acid regeneration—mild Steel=25 μm/hr

The increased rate of dissolution after acid regeneration can be attributed to some slight concentration of hydrogen peroxide in the regenerated acid.

I claim:

1. A method of decontaminating the surface of a body carrying radioactive contaminants which comprises treating the surface with a decontaminant comprising a solution of tetrafluoroboric acid $HBF_4$, treating the resultant liquor comprising decontaminant and dissolved species removed from the body surface with a first chemical agent which on reacting with the dissolved species yields insoluble compounds and regenerated decontaminant solution, and characterised in that the regenerated decontaminant solution is further treated to cause removal of the first chemical agent from the decontaminant solution.

2. A method as in claim 1 and wherein the first chemical agent comprises an acid.

3. A method as in claim 2 and wherein the first chemical agent comprises oxalic acid.

4. A method as in claim 1 and wherein the said further treatment comprises an oxidation treatment.

5. A method as in claim 4 and wherein the oxidation treatment comprises addition of a second chemical agent which is an oxidising agent.

6. A method as in claim 5 and wherein the oxidising agent is selected from potassium permanganate, potassium dichromate, lead (IV) compounds and cerium (IV) compounds.

7. A method as in claim 4 and wherein the oxidation treatment comprises photolytic decomposition.

8. A method as in claim 1 and wherein a third chemical agent is added to the decontaminant liquor to increase the rate of removal of the first chemical agent.

9. A method as in claim 8 and wherein the third chemical agent comprises a peroxide.

10. A method as in claim 1 and which includes the step of further treating the regenerated decontaminant solution by passing that solution through an ion exchange medium.

11. A method as in claim 1 and wherein the regenerated decontaminant solution is obtained in substantially pure form and is re-applied in such form to decontaminate further the surface of the said body.

12. A method as in claim 1 and wherein sold matter contained in the decontaminant liquor is separated from the liquor prior to treatment to add the first chemical agent thereto.

13. A method as in claim 1 and wherein precipitate produced by addition of the first chemical agent is separated from the decontaminant liquor prior to treatment to remove the first chemical agent.

14. A method as in claim 1 and wherein addition of the first chemical agent and the treatment to remove the chemical agent are carried out as successive steps in a common reactor vessel.

15. A method as in claim 14 and wherein different chemical agents are added to the vessel via different inlets.

16. A method as in claim 1 and wherein the regenerated $HBF_4$ decontaminant solution is treated, at the end of decontamination, with a material to neutralise the acid.

17. A method as in claim 16 and wherein calcium hydroxide is added to the regenerated $HBF_4$ solution.

* * * * *